US007254537B2

(12) United States Patent
Otani et al.

(10) Patent No.: US 7,254,537 B2
(45) Date of Patent: Aug. 7, 2007

(54) SPEECH INPUT DEVICE

(75) Inventors: Takeshi Otani, Kawasaki (JP); Yasushi Yamazaki, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 771 days.

(21) Appl. No.: 10/292,504

(22) Filed: Nov. 13, 2002

(65) Prior Publication Data

US 2003/0187640 A1 Oct. 2, 2003

(30) Foreign Application Priority Data

Mar. 28, 2002 (JP) ..... 2002-093165

(51) Int. Cl.
*G10L 21/00* (2006.01)

(52) U.S. Cl. ..... 704/233; 704/200

(58) Field of Classification Search ..... 704/200, 704/233

See application file for complete search history.

(56) References Cited

U.S. PATENT DOCUMENTS

| | | | | |
|---|---|---|---|---|
| 4,843,488 | A * | 6/1989 | Watatani et al. | 386/100 |
| 5,930,372 | A | 7/1999 | Kuriyama | |
| 6,038,532 | A * | 3/2000 | Kane et al. | 704/233 |
| 6,240,383 | B1 * | 5/2001 | Tanaka | 704/219 |
| 6,320,918 | B1 | 11/2001 | Walker et al. | |
| 6,324,499 | B1 * | 11/2001 | Lewis et al. | 704/233 |
| 6,778,959 | B1 * | 8/2004 | Wu et al. | 704/256 |

FOREIGN PATENT DOCUMENTS

| | | |
|---|---|---|
| EP | 0622724 A2 | 11/1994 |
| JP | 55-084010 | 6/1980 |
| JP | 57-184334 | 11/1982 |
| JP | 02-001661 | 1/1990 |
| JP | 05-307432 | 11/1993 |
| JP | 09-149157 | 6/1997 |
| JP | 09-204290 | 8/1997 |

OTHER PUBLICATIONS

Goodman et al., "Waveform Substitution Techniques for Recovering Missing Speech Segments in Packet Voice Communications", International Conference on Acoustics, Speech & Signal Processing, ICASSP, Tokyo, Apr. 7-11, 1986, New York, IEEE, US, vol. 4, Conf. 11, Apr. 7, 1986, pp. 105-108.

Communication mailed Mar. 13, 2007 from the Japanese Patent Office (including a partial English translation).

* cited by examiner

*Primary Examiner*—Daniel Abebe
(74) *Attorney, Agent, or Firm*—Staas & Halsey LLP

(57) ABSTRACT

A speech input device is provided with a microphone which inputs speech, a key entry detector which detects an operation of a key section which serves as a man-machine interface, and a noise eliminator which eliminates a component of an operation sound from the speech that is input into the microphone within a period in which the key entry detector detects the operation.

19 Claims, 15 Drawing Sheets

SPEECH INPUT DEVICE

BACKGROUND OF THE INVENTION

1) Field of the Invention

The present invention relates to a speech input device that requires speech input such as recording equipment, a cellular phone terminal or a personal computer.

2) Description of the Related Art

In recent years, a data communication function for transmitting and receiving text data of about several hundred characters is often installed, as a standard equipment, into a portable terminal such as a cellular phone terminal or a personal handyphone system (PHS) terminal besides a telephone conversation function.

According to IMT-2000 (International Mobile Telecommunications-2000) that is a next-generation communication scheme, one portable terminal uses a plurality of lines, and it is thereby possible to perform data communication without disconnecting speech communication while the speech communication is being held. Accordingly, the portable terminal of this type may possibly be used in a case where text is input by operating keys during a telephone conversation and then data communication is also performed.

In recent years, an attention has been paid to an Internet Protocol (IP) telephone system that requires a less expensive call charge than that of an ordinary telephone call. This IP telephone system is referred to as an Internet telephone system. This is a communication system enabling a telephone conversation similarly to an ordinary telephone by exchanging speech data between IP telephone devices each of which is provided with a microphone and a loudspeaker.

The IP telephone device is a computer that enables network communication and is equipped with an e-mail transmitting/receiving function through the operation of a man-machine interface such as a keyboard and a mouse.

Meanwhile, as explained above, if a man-machine interface (keys, keyboard, mouse) is operated during a telephone conversation using a conventional portable terminal or an IP telephone device, then an operation sound (click sound or the like) which is regarded as noise is captured by the microphone, and superimposed on speech. Therefore, tone quality is disadvantageously, greatly deteriorated.

To solve this problem, it may be considered to employ a method of eliminating the component of the noise (operation sound) contained in speech signals that are input into the microphone by means of a noise elimination device. According to this method, however, the side of the noise elimination device cannot predict the occurrence of an operation sound, and therefore noise elimination processing always needs to be executed to the sound signal that is input into the microphone. With this method, therefore, the noise elimination processing is conducted to the sound signal even if no noise is present, unavoidably causing the deterioration of tone quality.

SUMMARY OF THE INVENTION

It is an object of the present invention to provide a speech input device capable of efficiently eliminating an operation sound regarded as noise that is produced when a man-machine interface is operated and enhancing tone quality.

The speech input device according to one aspect of this invention comprises a speech input unit which inputs speech, a detection unit which detects an operation of a man-machine interface, and a noise eliminator which eliminates a component of an operation sound of the man-machine interface from the speech that is input into the speech input unit within a period in which the operation is detected by the detection unit.

The speech input device according to another aspect of this invention comprises a speech input unit which inputs speech, and a control unit which outputs a control signal for controlling respective sections based on an operation signal indicating that a man-machine interface is operated. The speech input device also comprises a detection unit which detects an operation of the man-machine interface based on the control signal, and a noise eliminator which eliminates a component of an operation sound of the man-machine interface from the speech that is input into the speech input unit within a period in which the operation is detected by the detection unit.

The speech input device according to still another aspect of this invention comprises a speech input unit which inputs speech, a speech information accumulation unit which accumulates information on the speech that is input into the speech input unit, a detection unit which detects an operation of a man-machine interface, and a noise eliminator which reads the speech information from the speech information accumulation unit when the operation is detected by the detection unit, and which eliminates a component of an operation sound of the man-machine interface from the speech that is input into the speech input unit within an operation-detected period.

The speech input device according to still another aspect of this invention comprises a speech input unit which inputs speech, and a detection unit which detects an operation of a man-machine interface and outputs information for an operation time which corresponds to a start of the operation and an end of the operation. The speech input device also comprises a noise eliminator which eliminates a component of an operation sound of the man-machine interface from the speech that is input into the speech input unit within an operation-detected period, the period being determined based on the information for the operation time when the operation is detected by the detection unit.

The speech input method according to still another aspect of this invention comprises steps of inputting speech, detecting an operation of a man-machine interface, and eliminating a component of an operation sound of the man-machine interface from the speech that is input in the speech inputting step within a period in which the operation is detected in the detection step.

The speech input program, according to still another aspect of this invention, that allows a computer to function as the components in the above-mentioned devices, respectively.

The speech input device according to still another aspect of this invention comprises a speech input unit which inputs speech, a detection unit which detects an operation of a man-machine interface, and a suppression processing unit which suppresses a period in which the operation of the man-machine interface is detected, in the speech that is input into the speech input unit within the period in which the operation is detected by the detection unit.

The speech input method according to still another aspect of this invention comprises steps of inputting speech, detecting an operation of a man-machine interface, and suppressing a period in which the operation of the man-machine interface is detected, in the speech that is input in the speech inputting step within the period in which the operation is detected in the detecting step.

The speech input program, according to still another aspect of this invention, that allows a computer to function as the components in the above-mentioned device.

These and other objects, features and advantages of the present invention are specifically set forth in or will become apparent from the following detailed descriptions of the invention when read in conjunction with the accompanying drawings.

DETAILED DESCRIPTION

The present invention relates to a speech input device that requires speech input such as recording equipment, a cellular phone terminal or a personal computer. More particularly, the present invention relates to the speech input device capable of efficiently eliminating an operation sound (click sound or the like) which is regarded as noise produced when a man-machine interface such as a key or a mouse is operated in parallel to speech input, and enhancing tone quality.

Embodiments of the speech input device according to the present invention will be explained below in detail with reference to the drawings.

Figure 1:
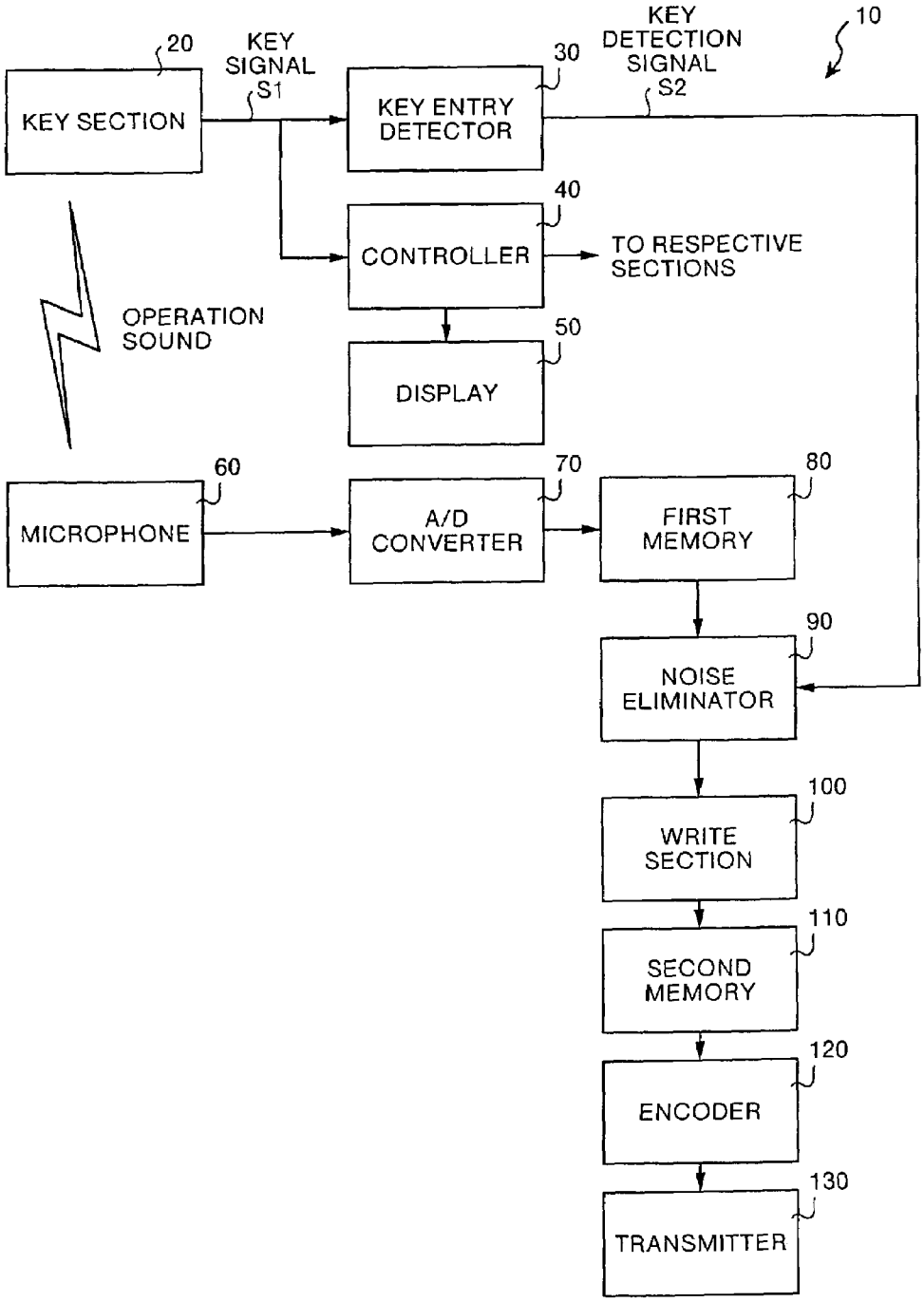
FIG. 1 is a block diagram showing the configuration of a first embodiment of the present invention.
Figure 2:
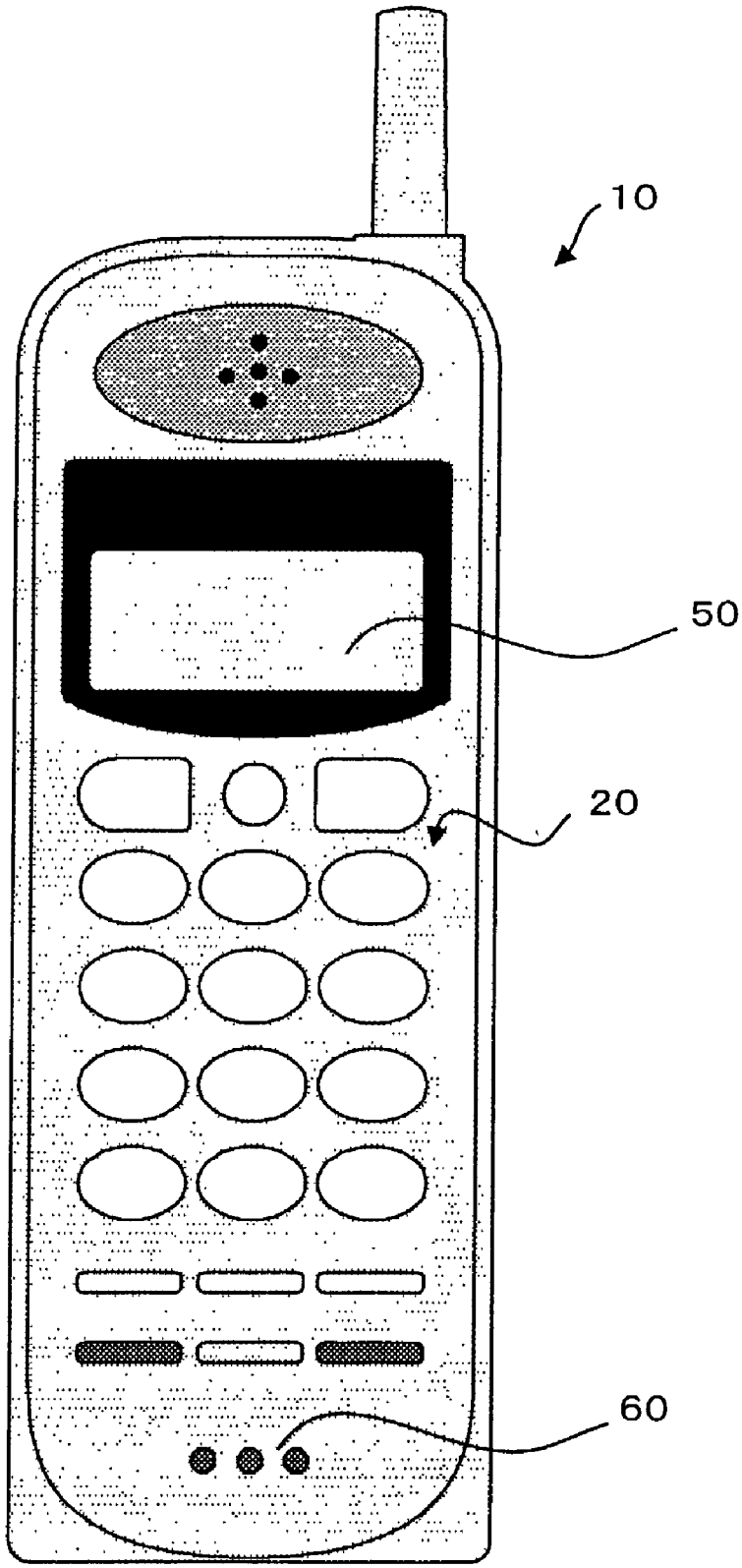
FIG. 2 is a view showing the outer configuration of a portable terminal 10 shown in FIG. 1.

FIG. 1 is a block diagram showing the configuration of a first embodiment of the present invention. In FIG. 1, the configuration of the main parts of a portable terminal 10 which has both a telephone conversation function and a data communication function. FIG. 2 is a view showing the outer configuration of the portable terminal 10 shown in FIG. 1. In FIG. 2, portions corresponding to those in FIG. 1 are denoted by the same reference symbols as those in FIG. 1, respectively.

A key section 20 shown in FIGS. 1 and 2 is a man-machine interface consisting of a plurality of keys which are used to input numbers, text, and the like. This key section 20 is operated by a user when a telephone number is input or the text of e-mail is input.

During this operation, an operation sound (click sound) is produced. This key click sound is captured by a microphone 60 explained later during a telephone conversation and is input while being superimposed on speech by a speaker.

A key signal S1 that corresponds to a key code or the like is output from the key section 20 during the operation of the key section 20. A key entry detector 30 outputs a key detection signal S2 indicating that a corresponding key has been operated in response to input of the key signal S1.

A controller 40 generates a control signal (digital) based on the key signal S1 and controls respective sections. For example, the controller 40 performs controls such as interpreting text from the key signal S1 and displaying this text on a display 50 (see FIG. 2).

The microphone 60 (see FIG. 2) converts the speech of the speaker and the operation sound from the key section 20 into a speech signal. An A/D (Analog/Digital) converter 70 digitizes the analog speech signal from the microphone 60. A first memory 80 buffers the speech signal that is output from the A/D converter 70.

A noise eliminator 90 functions to eliminate the component of the operation sound in an interval in which the component of the operation sound is superimposed on the speech signal from the first memory 80 as noise, while using the key detection signal S2 as a trigger.

Specifically, as will be explained later, the noise is eliminated by performing waveform interpolation (see FIG. 5A and FIG. 5B) for interpolating a signal waveform in this interval into a corresponding speech signal waveform. In addition, while the key detection signal S2 is not input, the noise eliminator 90 directly outputs the speech signal from the first memory 80 to a write section 100 which is located in rear of the first memory 80.

The write section 100 writes the speech signal (or the speech signal from which the operation sound component is eliminated) from the noise eliminator 90 in a second memory 110. An encoder 120 encodes the speech signal from the second memory 110. A transmitter 130 transmits the output signal of the encoder 120.

Figure 3:
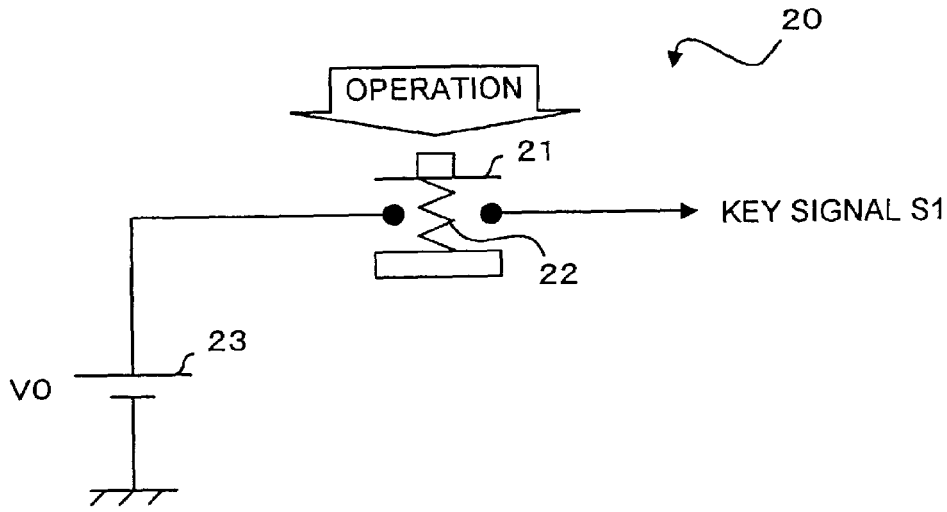
FIG. 3 is a diagram showing the configuration of a key section 20 shown in FIG. 1.

FIG. 3 is a diagram showing the configuration of the key section 20 shown in FIG. 1. In FIG. 3, a key 21 is provided via a spring 22. When the key 21 is operated, a bias power supply 23 (voltage V0) is turned on and the key signal S1 is output. Actually, the key section 20 consists of a plurality of keys.

Figure 4:
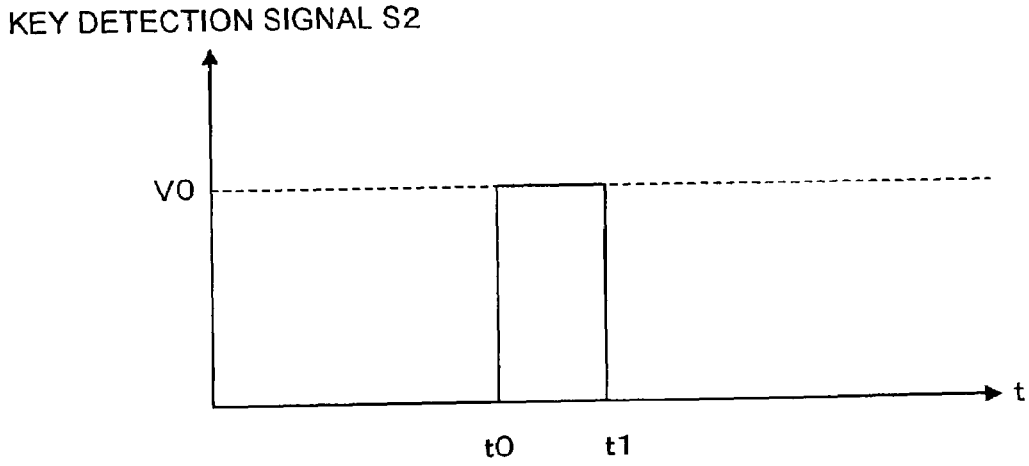
FIG. 4 is a diagram showing the waveform of a key detection signal S2 shown in FIG. 1, FIG. 5A and FIG. 5B are diagrams which explain processing for waveform interpolation in the first embodiment.

FIG. 4 is a diagram showing the waveform of the key detection signal S2 shown in FIG. 1. When the key 21 (see FIG. 3) is operated during, for example, a period between time t0 and t1, the key signal S1 is input into the key entry detector 30. In this case, the key detection signal S2 shown in FIG. 4 is output from the key entry detector 30.

The operation of the first embodiment will next be explained with reference to flow charts shown in FIGS. 6 and 7. A case such that the key section 20 is operated and the component of the operation sound which is captured by the microphone 60 is eliminated as noise, will be explained below.

Figure 6:
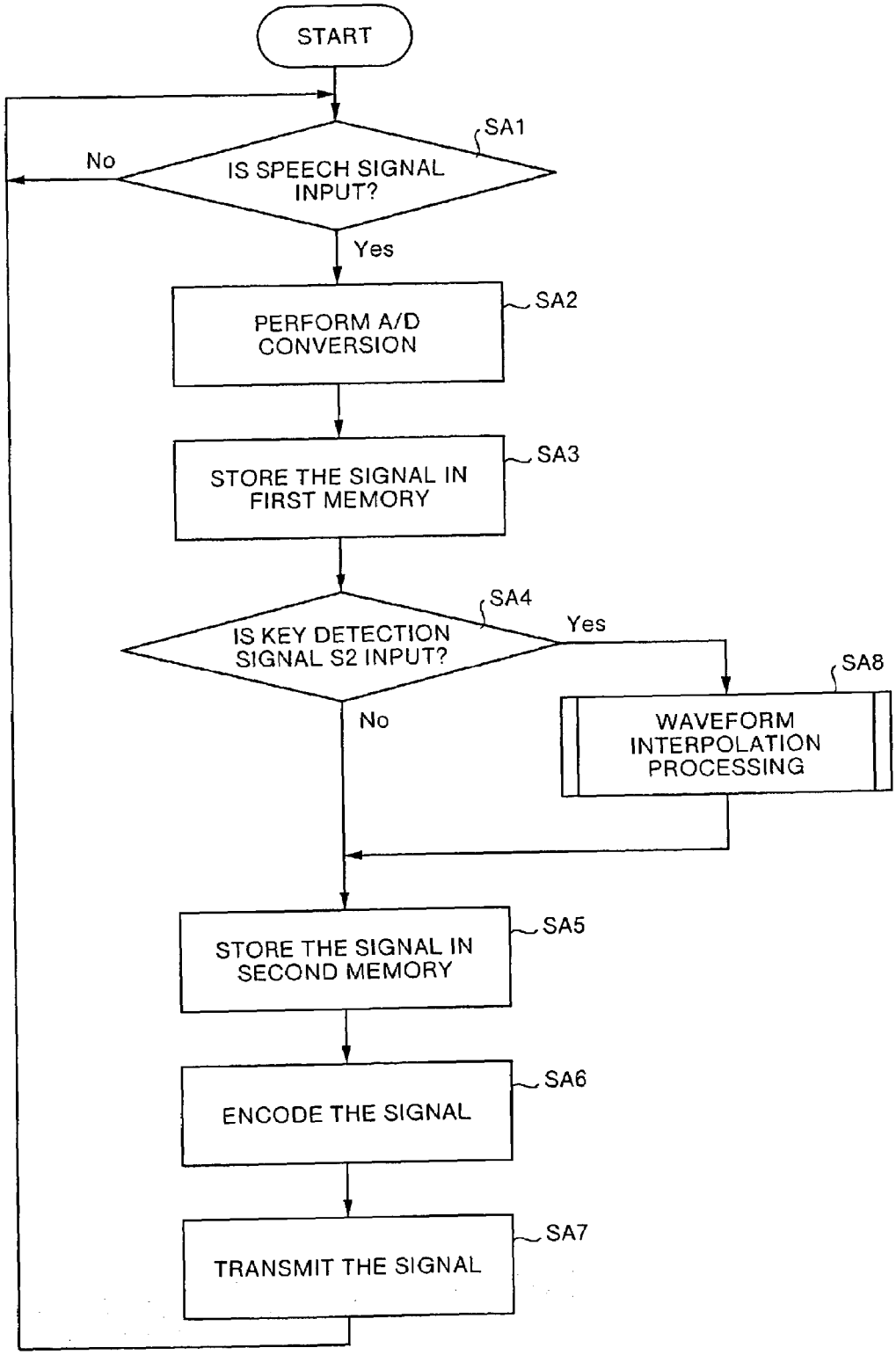
FIG. 6 is a flow chart which explains the operations of the first embodiment.

At step SA1 shown in FIG. 6, the A/D converter 70 determines whether or not a speech signal is input from the microphone 60. It is assumed herein that the result of determination is "No" and this determination is repeated. When a telephone conversation starts, the speech of a speaker is input, as a speech signal, into the A/D converter 70 by the microphone 60.

Accordingly, the A/D converter 70 outputs the result of determination as "Yes" at step SA1. At step SA2, the A/D converter 70 digitizes the analog speech signal. At step SA3, the speech signal (digital) from the A/D converter 70 is stored in the first memory 80.

At step SA4, the noise eliminator 90 determines whether or not the key detection signal S2 is input from the key entry detector 30. In this case, it is assumed that the determination result is "No" and the speech signal from the first memory 80 is directly output to the write section 100. At step SA5, the write section 100 stores the speech signal in the second memory 110.

Figure 5A:
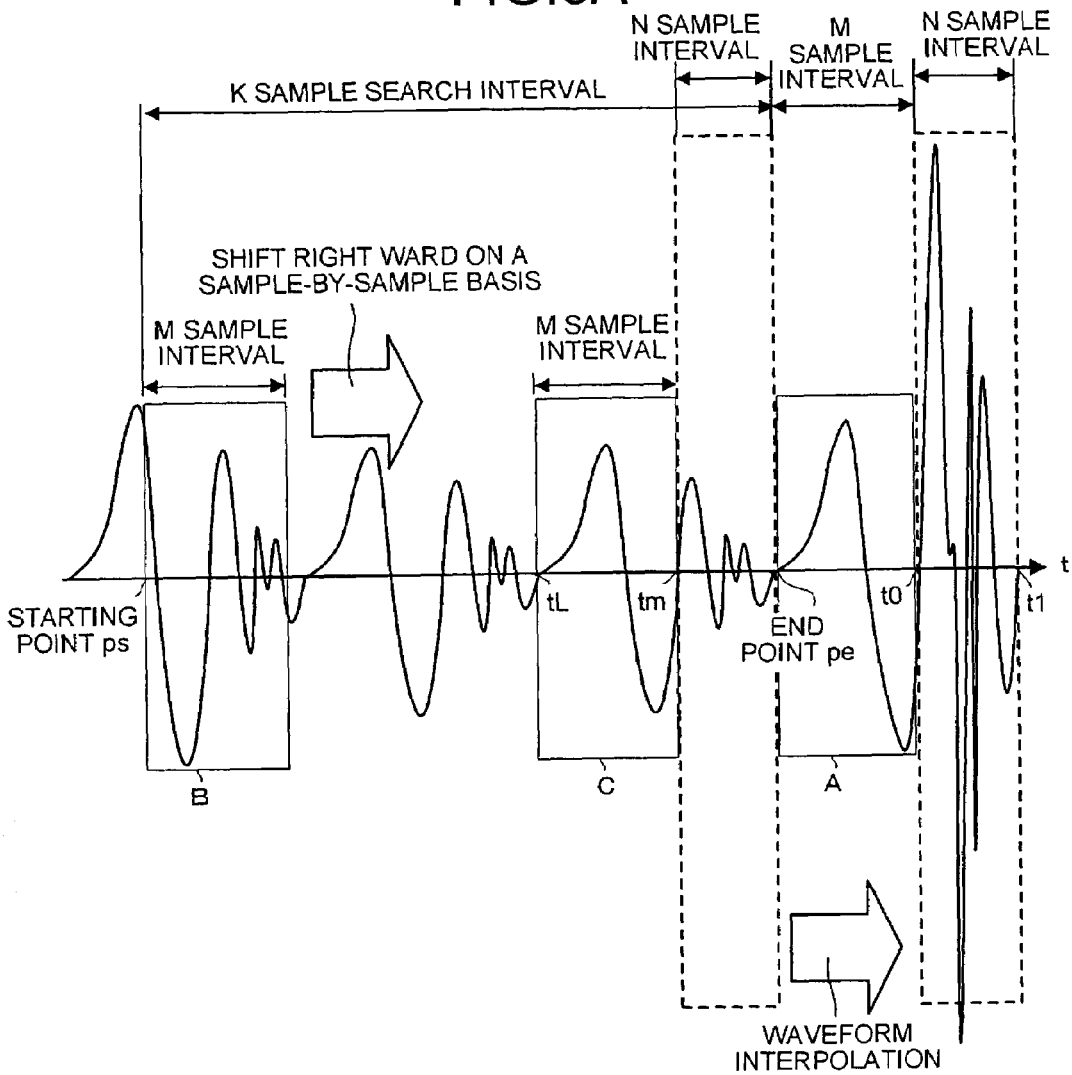

At step SA6, the encoder 120 encodes the speech signal from the second memory 110. At step SA7, the transmitter 130 transmits the output signal thus encoded. Thereafter, a series of operations are repeated while the speech signal having a waveform shown in FIG. 5A is input.

When the key section 20 is operated at time t0 (see FIG. 5A), the key signal S1 is input into the key entry detector 30 and the controller 40. In addition, at time t0, an operation sound is captured by the microphone 60 and, therefore, the operation sound is superposed on the speech. As a result, the amplitude of the speech signal suddenly increases at time t0 as shown in FIG. 5A.

In response to this, the noise eliminator 90 outputs the determination result of step SA4 as "Yes" and executes waveform interpolation at step SA8. This waveform interpolation is the processing in which a waveform in an N sample interval longer than an interval from time t0 to time t1 during which the operation sound is superimposed on the speech, is interpolated by a waveform which is a waveform before time t0 and which has a high correlation coefficient (FIG. 5B; waveform D), thereby eliminating the component of the operation sound which is regarded as noise from the speech signal.

Figure 7:
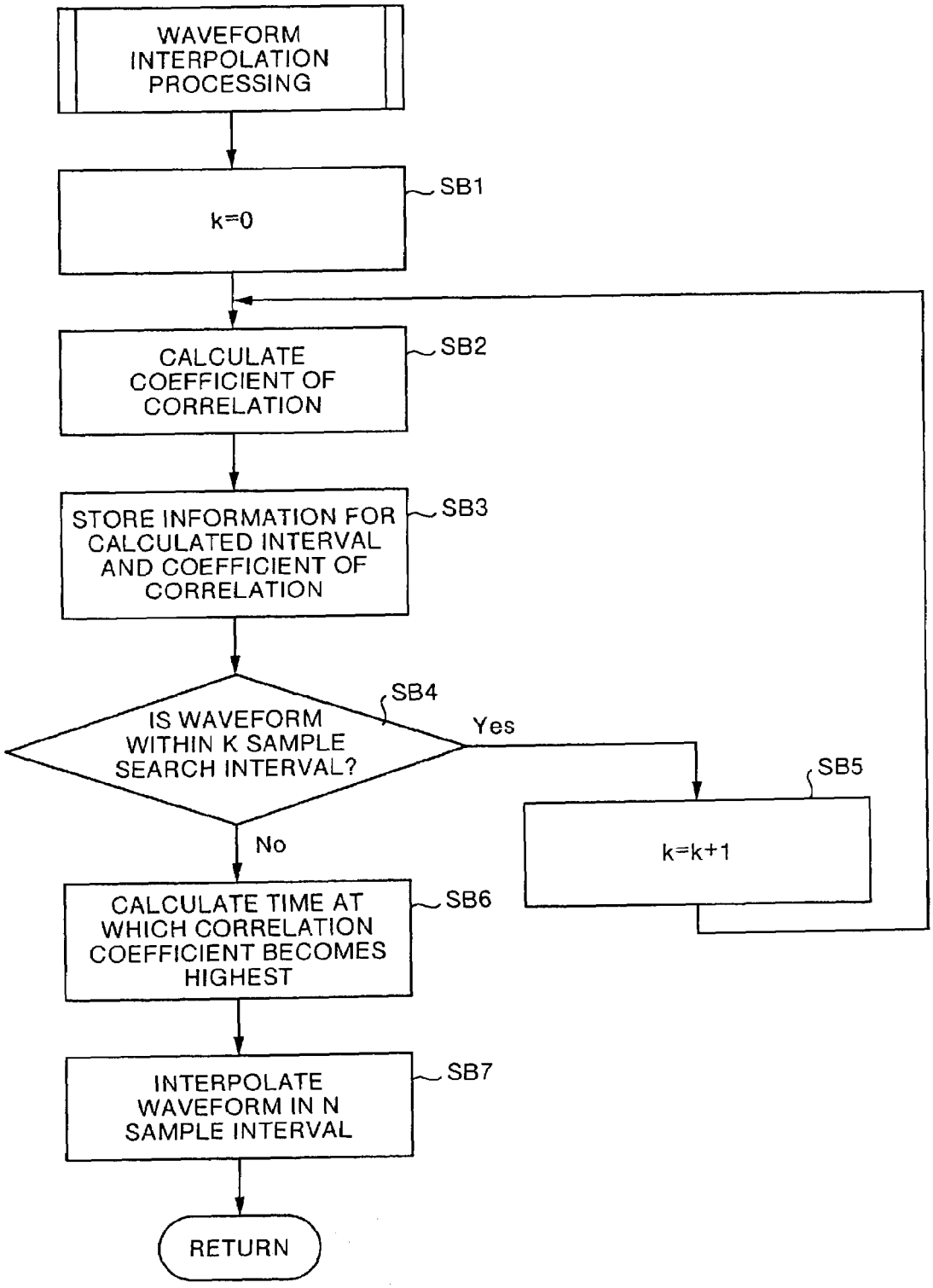
FIG. 7 is a flow chart which explains the processing for the waveform interpolation shown in FIG. 6.

Specifically, at step SB1 shown in FIG. 7, the noise eliminator 90 substitutes 0 into [k] of a correlation coefficient cor[k] as expressed by the following equation (1).

$$cor[k] = \frac{\sum_{j=1}^{M} (x[t0-j] \cdot x[t0-k-j])}{M} \tag{1}$$

ps≦k≦pe ps: starting point of search interval of k sample, pe: end point of search interval of k sample, x[]: input speech signal, and t0: starting time of detecting operation sound.

The correlation coefficient represents the correlation between a waveform A in an M sample interval just before time t0 (see FIG. 4) shown in FIG. 5A, i.e., the time at which the operation sound is produced and a waveform (e.g., waveform B shown in FIG. 5A in an M sample interval) within the search interval of the k sample (starting point ps to end point pe) prior to the M sample interval having the waveform A. The higher coefficient of the correlation signifies that the similarity of the both waveforms is high.

At steps SB1 to SB5 to be explained next, while the M sample interval is shifted rightward one by one from the starting point ps within the search interval of k sample ("k sample search interval"), the coefficient of the correlation between the waveform A and a waveform (in the M sample interval) in the k sample search interval is calculated from the equation (1).

At step SB2, the noise eliminator 90 calculates the coefficient of the correlation between the waveform A and a waveform B at k=0, from the equation (1). At step SB3, the noise eliminator 90 stores information for calculated intervals (for the M samples from the starting point ps) each in which the correlation of the correlation is calculated and stores the correlation coefficients in a memory (not shown). At the step SB4, the noise eliminator 90 determines whether or not a waveform (the waveform B in this case) corresponding to the waveform A is in the k sample search interval and outputs a determination result of "Yes" in this case.

At step SB5, the noise eliminator 90 increments k in the equation (1) by one. Accordingly, a waveform which is shifted rightward from the waveform shown in FIG. 5A by one sample becomes a calculation target for the coefficient of the correlation with the waveform A. Thereafter, the processing in step SB2 to step SB5 is repeated to sequentially calculate the coefficients of the correlation between respective waveforms in the k sample search interval (shifted rightward on a sample-by-sample basis) and the waveform A.

If the determination result at step SB4 becomes "No", the noise eliminator 90 calculates time tL at which the correlation coefficient cor[k] becomes the highest from the following equation (2) at step SB6. The correlation coefficient cor[k] is calculated from the equation (1).

$$tL = \arg_{k=ps}^{pe} \max(cor[k]) \tag{2}$$

In the equation (2), "arg max(cor[k])" is a function which indicates that the time tL at which the correlation coefficient cor[k] becomes the highest is to be calculated in the period from the starting point ps to the end point pe shown in FIG. 5A. That is, in the equation (2), the time for specifying a waveform most similar to the waveform A shown in FIG. 5A is calculated. If the coefficient of the correlation between the waveform A and the waveform C shown in FIG. 5A is determined to be the highest, then the time tL indicating the left end of the waveform C is calculated.

Figure 5B:
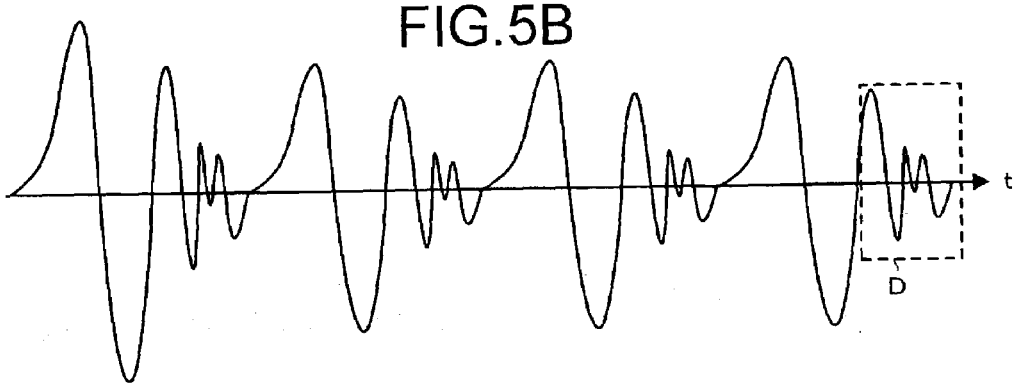

At step SB7, the noise eliminator 90 interpolates a waveform (which includes an operation sound component) in an N sample interval from time t0 by the waveform in an N sample interval from time tm indicating the right end of the waveform C. Accordingly, in the first embodiment, the waveform is interpolated by the waveform D as shown in FIG. 5B and the operation sound component is eliminated, thereby enhancing tone quality. Alternatively, in the first embodiment, the processing for suppression in which the amplitude of the speech signal in the N sample interval is multiplied by x (where 0≦x<1) may be executed in place of the waveform interpolation.

As explained so far, according to the first embodiment, when the operation of the key section 20 which serves as the man-machine interface is detected, the waveform interpolation shown in FIG. 5A is conducted to eliminate the component of the operation sound. Therefore, it is possible to efficiently eliminate the operation sound regarded as noise and to enhance tone quality.

In the first embodiment, the configuration example in which the key detection signal S2 is output based on the key signal S1 from the key section 20 shown in FIG. 1 has been explained. This configuration may be replaced by another configuration example in which the key detection signal S2 is output based on a control signal from the controller 40. This configuration example will be explained below as a second embodiment.

Figure 8:
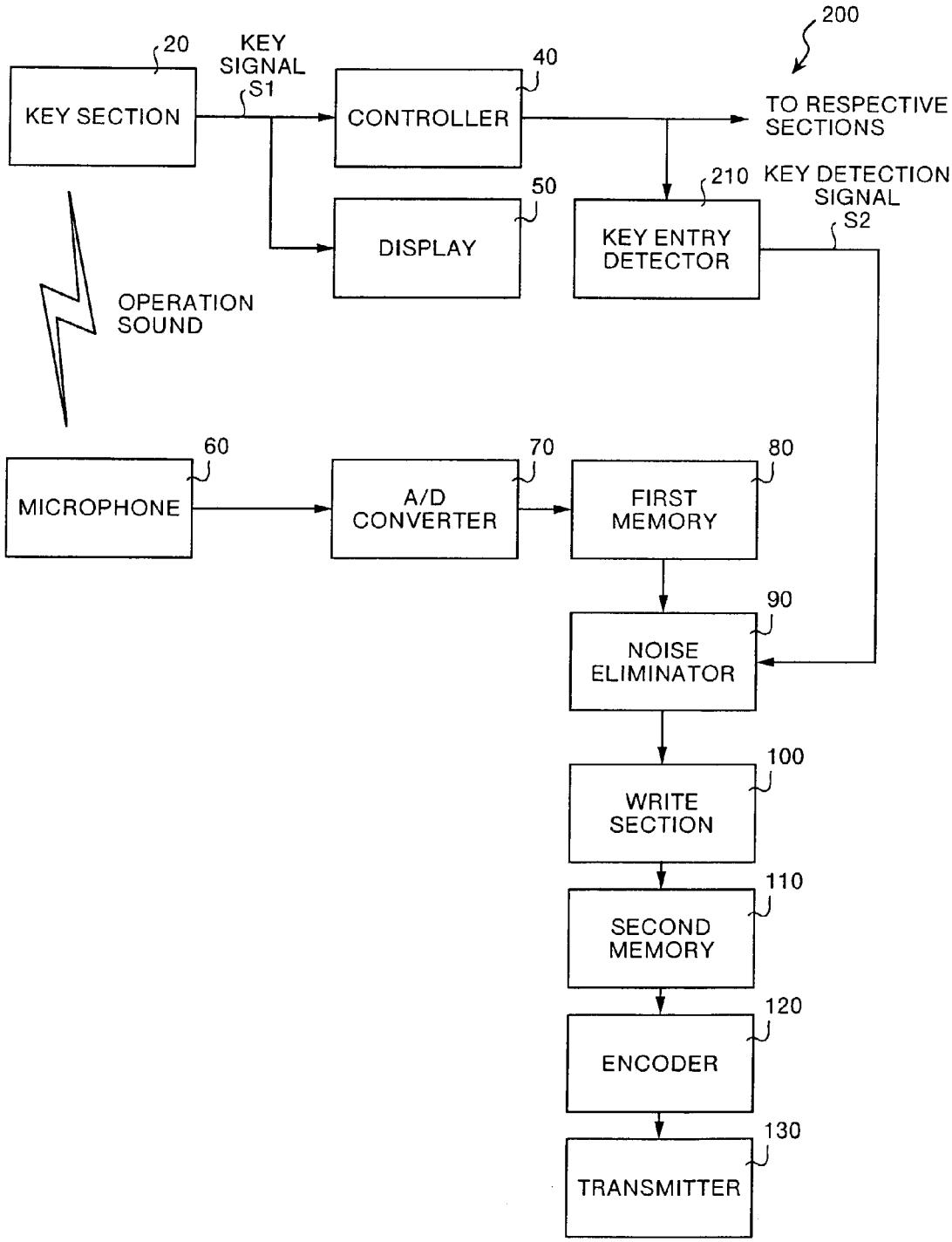
FIG. 8 is a block diagram showing the configuration of a second embodiment of the present invention.

FIG. 8 is a block diagram showing the configuration of the second embodiment of the present invention. In FIG. 8, portions corresponding to those in FIG. 1 are denoted by the same reference symbols as those in FIG. 1, respectively and will not be explained herein. In a portable terminal 200 shown in FIG. 8, a key entry detector 210 is provided in place of the key entry detector 30 shown in FIG. 1.

This key entry detector 210 generates a key detection signal S2 from a control signal (digital signal) from a controller 40 and outputs the key detection signal S2 to the noise eliminator 90. It is noted that the basic operations of the second embodiment are the same as those of the first embodiment except for the above operation.

As explained so far, the second embodiment can obtain the same advantages as those of the first embodiment.

In the second embodiment, the configuration example in which the first memory 80 shown in FIG. 8 is provided is explained. Alternatively, the configuration may be replaced by a configuration example in which this first memory 80 is not provided. This configuration example will be explained below as a third embodiment.

Figure 9:
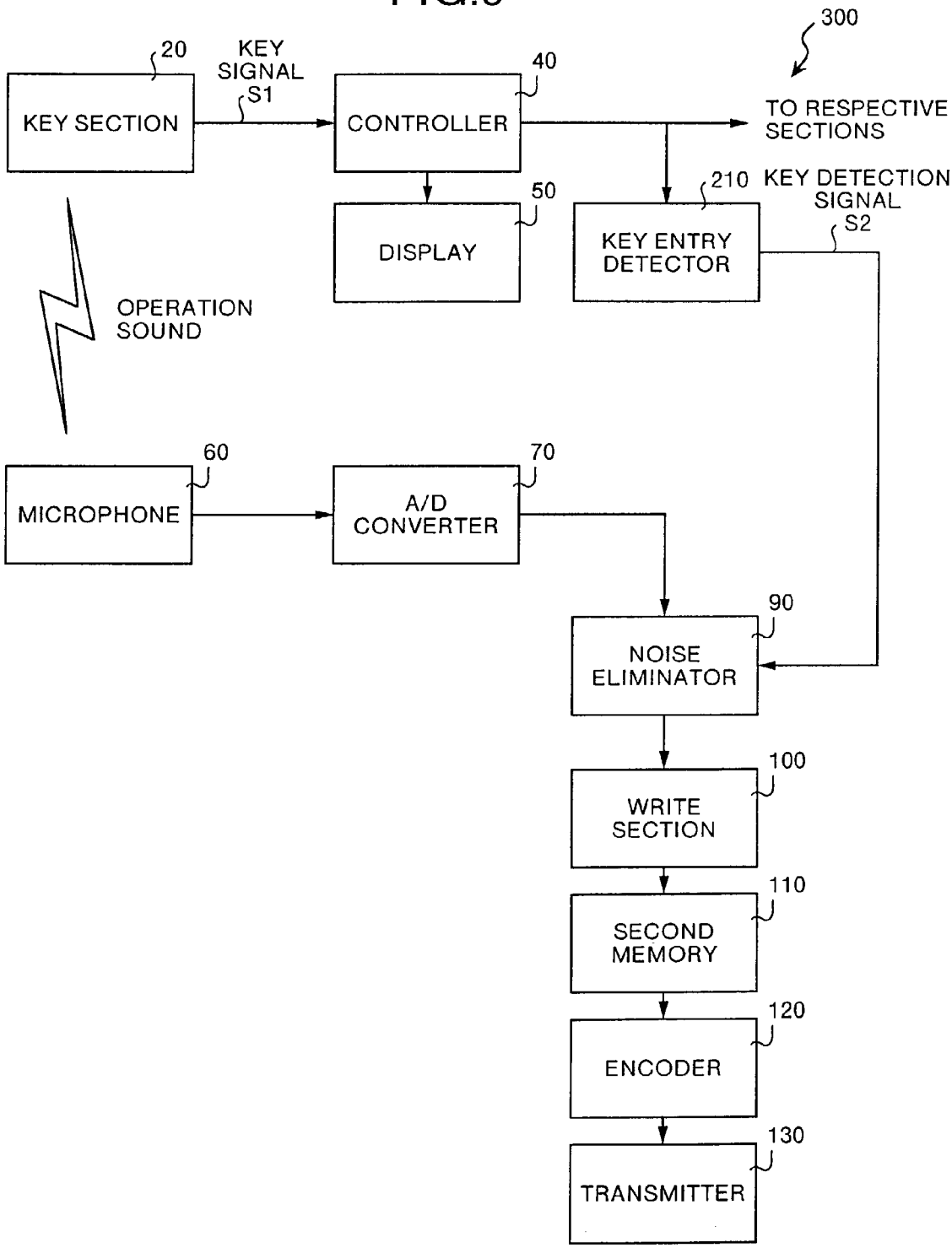
FIG. 9 is a block diagram showing the configuration of a third embodiment of the present invention.

FIG. 9 is a block diagram showing the configuration of the third embodiment of the present invention. In FIG. 9, portions corresponding to those in FIG. 8 are denoted by the same reference symbols as those in FIG. 8, respectively and will not be explained herein. In a portable terminal 300 shown in FIG. 9, the first memory 80 shown in FIG. 8 is not provided. It is noted that the basic operations of the third embodiment are the same as those of the first embodiment except for the above operation.

As explained so far, the third embodiment can obtain the same advantages as those of the first embodiment.

In the first embodiment, the configuration example in which the key detection signal S2 is output based on the key signal S1 from the key section 20 shown in FIG. 1 has been explained. This configuration example may be replaced by a configuration example in which an A/D converter and a key signal holder are provided and the key detection signal S2 is output based on a key signal from the key signal holder. This configuration example will be explained below as a fourth embodiment.

Figure 10:
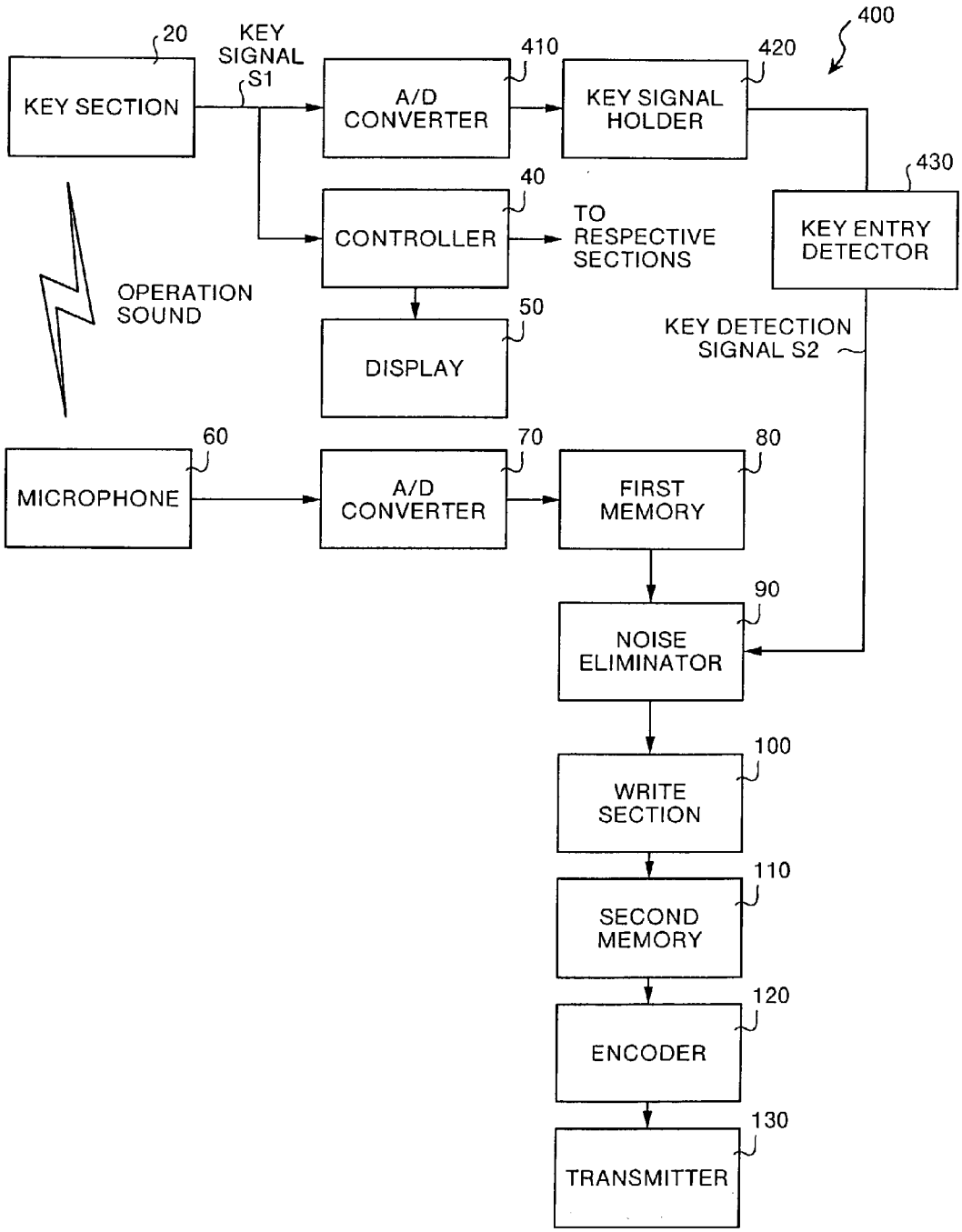
FIG. 10 is a block diagram showing the configuration of a fourth embodiment of the present invention.

FIG. 10 is a block diagram showing the configuration of the fourth embodiment of the present invention. In FIG. 10, portions corresponding to those shown in FIG. 1 are denoted by the same reference symbols as those in FIG. 1, respectively and will not be explained herein. In a portable terminal 400 shown in FIG. 10, an A/D converter 410, a key signal holder 420, and a key entry detector 430 are provided in place of the key entry detector 30 shown in FIG. 1.

The A/D converter 410 digitizes a key signal S1 (analog signal) from the key section 20. The key signal holder 420 holds the key signal (digital signal) from the A/D converter 410. The key entry detector 430 generates the key detection signal S2 based on the key signal which is held in the key signal holder 420 and outputs the key detection signal S2 to the noise eliminator 90. The basic operations of the fourth embodiment are the same as those of the first embodiment except for the operations explained above.

As explained so far, the fourth embodiment can obtain the same advantages as those of the first embodiment.

In the first embodiment, the configuration example in which the key detection signal S2 is directly output from the key entry detector 30 to the noise eliminator 90 shown in FIG. 1 has been explained. This configuration may be replaced by a configuration example in which a time of detecting the operation is monitored based on the key detection signal S2 and a signal indicating an operation-detected time ("a detection time signal") is output to the noise eliminator 90. This configuration example will be explained below as a fifth embodiment.

Figure 11:
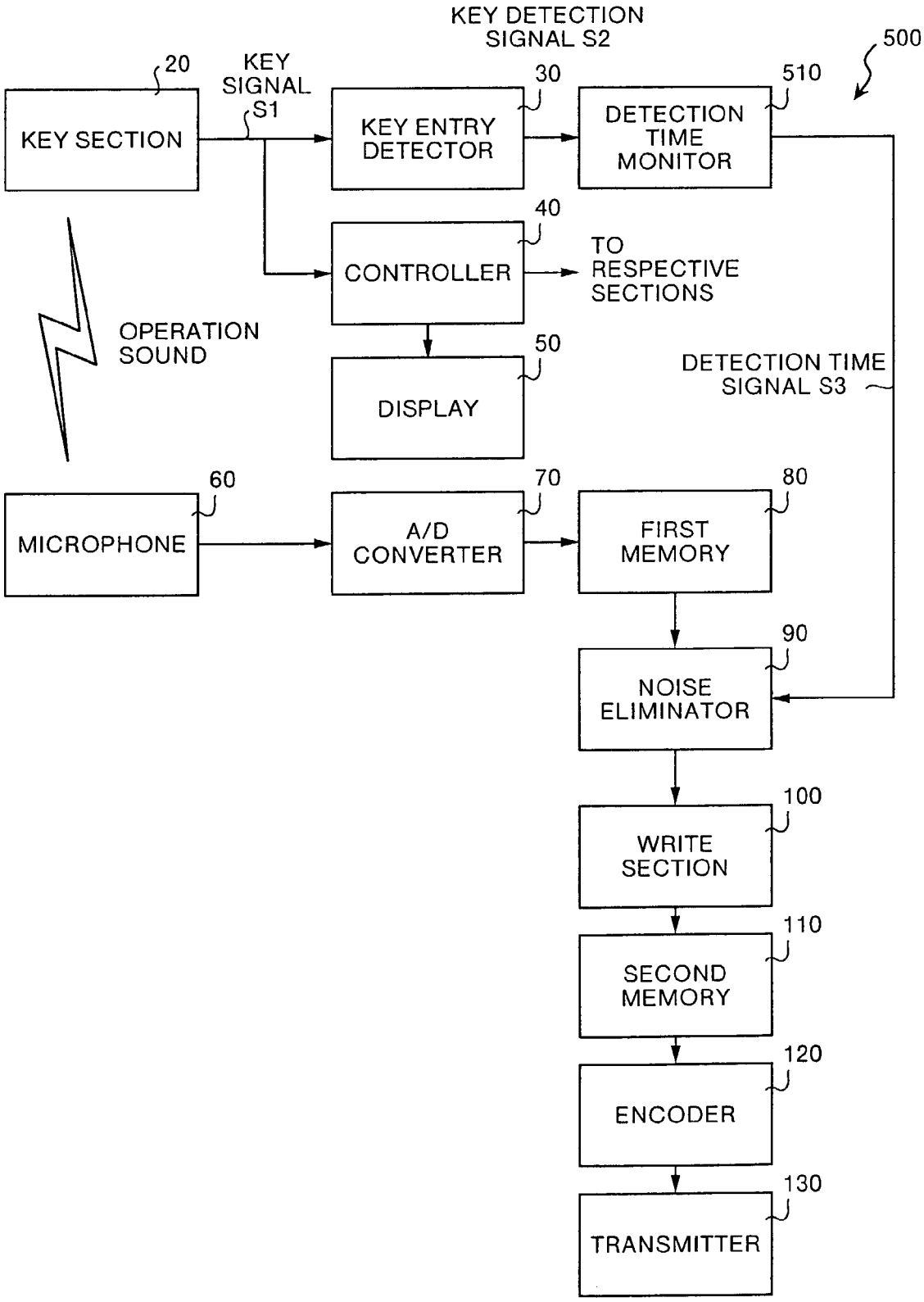
FIG. 11 is a block diagram showing the configuration of a fifth embodiment of the present invention.

FIG. 11 is a block diagram showing the configuration of the fifth embodiment of the present invention. In FIG. 11, portions corresponding to those in FIG. 1 are denoted by the same reference symbols as those in FIG. 1, respectively and will not be explained herein. In a portable terminal 500 shown in FIG. 11, a detection time monitor 510 is inserted between the key entry detector 30 and the noise eliminator 90 shown in FIG. 1.

This detection time monitor 510 monitors a key entry while using the rise and fall of the key detection signal S2 (see FIG. 4) from the key entry detector 30 as triggers, and outputs the time of the rise (starting time of operation) and the time of the fall (end time of the operation) to the noise eliminator 90 as a detection time signal S3.

The noise eliminator 90 executes the processing for waveform interpolation based on the starting time of the operation ("operation start time") and the end time of the operation ("operation end time") that are obtained from the detection time signal S3. It is noted that the basic operations of the fifth embodiment are the same as those of the first embodiment except for the operations explained above.

As explained so far, the fifth embodiment can obtain the same advantages as those of the first embodiment.

In the fifth embodiment, the configuration example in which the detection time signal S3 is output from the detection time monitor 510 to the noise eliminator 90 shown in FIG. 11 has been explained. This configuration may be replaced by a configuration example in which a reference signal is supplied to both the detection time monitor 510 and the noise eliminator 90 to synchronize the sections 510 and 90 using this reference signal. This configuration example will be explained below as a sixth embodiment.

Figure 12:
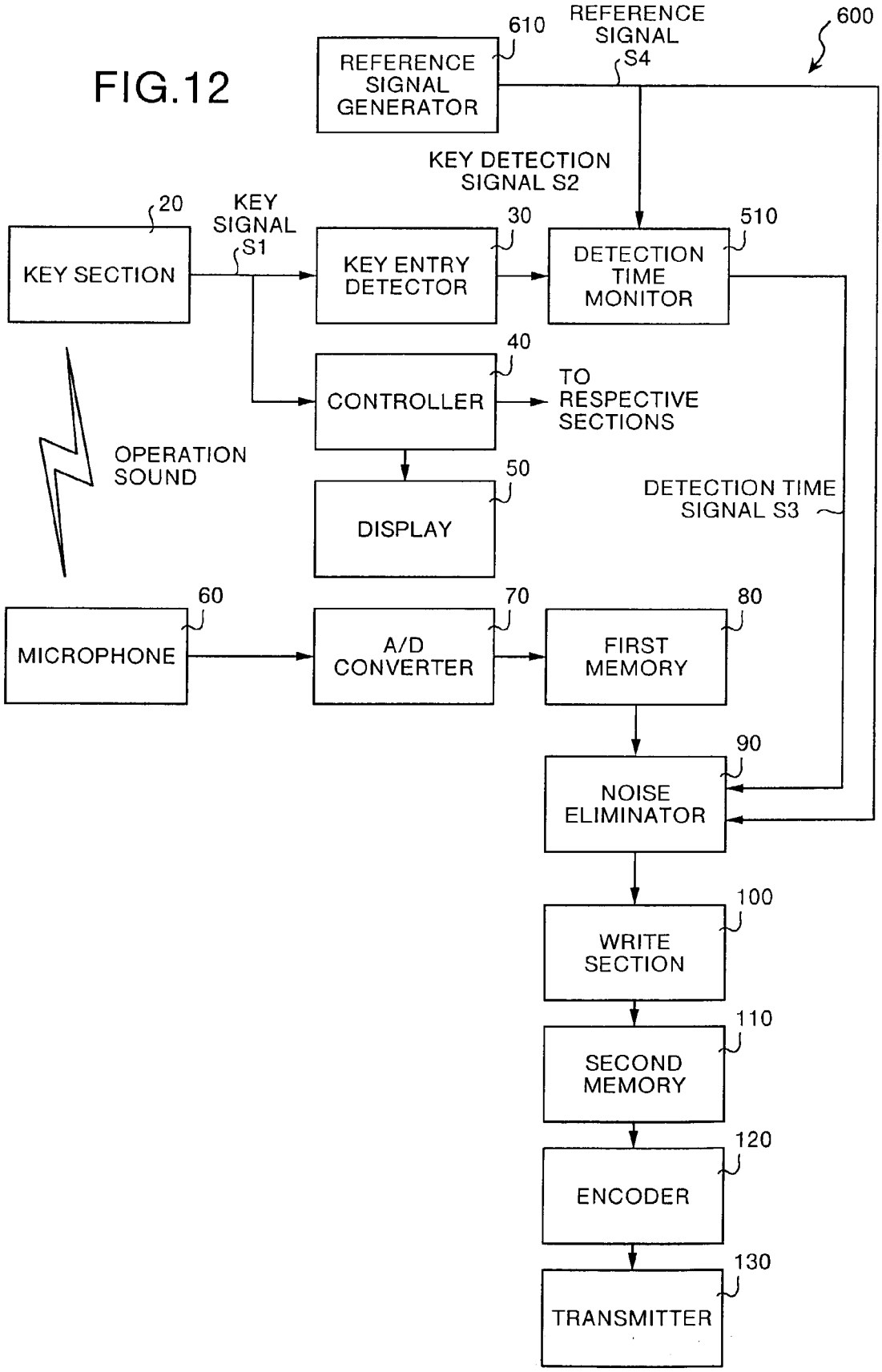
FIG. 12 is a block diagram showing the configuration of a sixth embodiment of the present invention.

FIG. 12 is a block diagram showing the configuration of the sixth embodiment of the present invention. In FIG. 12, portions corresponding to those shown in FIG. 11 are denoted by the same reference symbols as those in FIG. 11, respectively and will not be explained herein. A reference signal generator 610 is provided in a portable terminal 600 show in FIG. 12.

Figure 13:
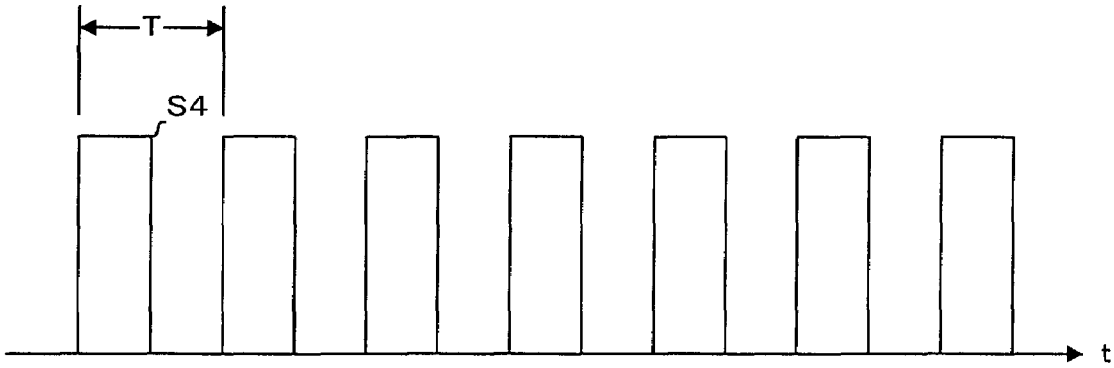
FIG. 13 is a diagram showing the waveform of a reference signal S4 shown in FIG. 12.

The reference signal generator 610 generates a reference signal S4 having a fixed cycle (known) shown in FIG. 13 and supplies the reference signal S4 to both the detection time monitor 510 and the noise eliminator 90. The detection time monitor 510 generates the detection time signal S3 based on the reference signal S4. The detection time monitor 510 and the noise eliminator 90 are synchronized with each other by the reference signal S4. It is noted that the basic operations of the sixth embodiment are the same as those of the first embodiment except for the operations explained above.

As explained so far, the sixth embodiment can obtain the same advantages as those of the first embodiment.

In each of the first to sixth embodiments, the configuration example in which the configuration of eliminating the component of the operation sound from the speech signal is applied to the portable terminal, has been explained. This configuration may be replaced by a configuration example in which the configuration of eliminating the component of the operation sound from the speech signal is applied to an IP telephone system. This configuration example will be explained below as a seventh embodiment.

Figure 14:
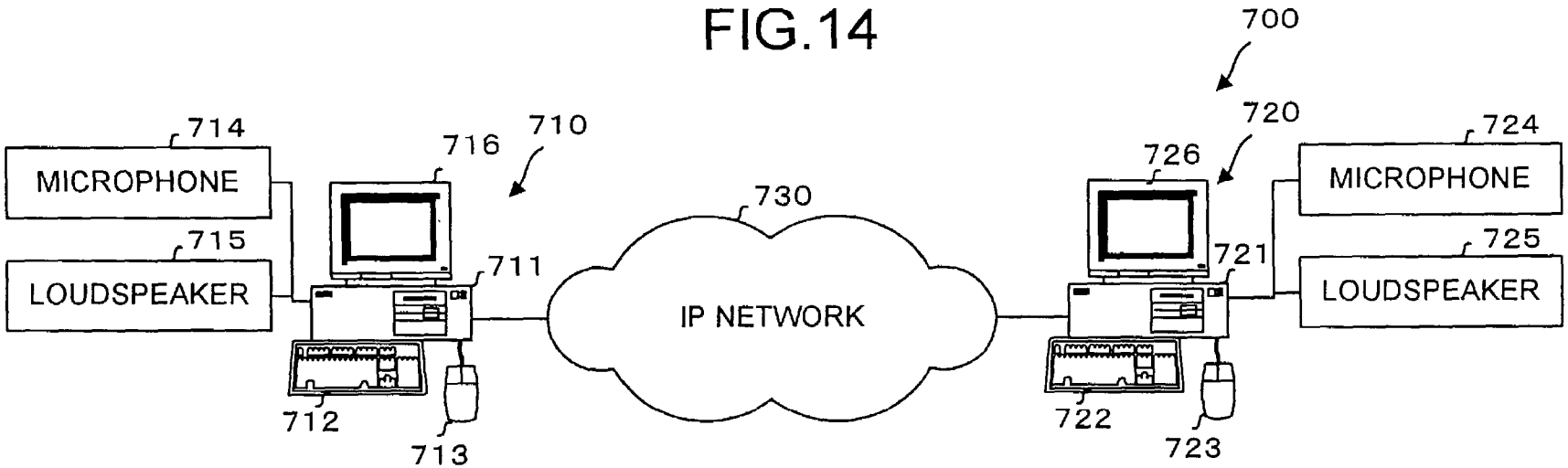
FIG. 14 is a block diagram showing the schematic configuration of a seventh embodiment of the present invention.

FIG. 14 is a block diagram schematically showing the configuration of the seventh embodiment of the present invention. In FIG. 14, an IP telephone system 700 is shown. The IP telephone system 700 enables performance of data communication (e-mail communication) in addition to a telephone conversation between an IP telephone device 710 and an IP telephone device 720 through an IP network 730.

The IP telephone device 710 includes a computer terminal 711, a keyboard 712, a mouse 713, a microphone 714, a loudspeaker 715, and a display 716. The IP telephone device 710 has a telephone function and a data communication function. The keyboard 712 and the mouse 713 are used to input text and perform various operations during the data communication. The microphone 714 converts speech of a speaker into speech signals during the telephone conversation. The loudspeaker 715 outputs the speech of a counterpart speaker during the telephone conversation.

The IP telephone device 720 has the same configuration as that of the IP telephone device 710. The IP telephone device 720 includes a computer terminal 721, a keyboard 722, a mouse 723, a microphone 724, a loudspeaker 725, and a display 726. The IP telephone device 720 has a telephone function and a data communication function. The keyboard 722 and the mouse 723 are used to input text and perform various operations during the data communication. The microphone 724 converts the speech of a speaker into speech signals during the telephone conversation. The loudspeaker 725 outputs the speech of a counterpart speaker during the telephone conversation.

Figure 15:
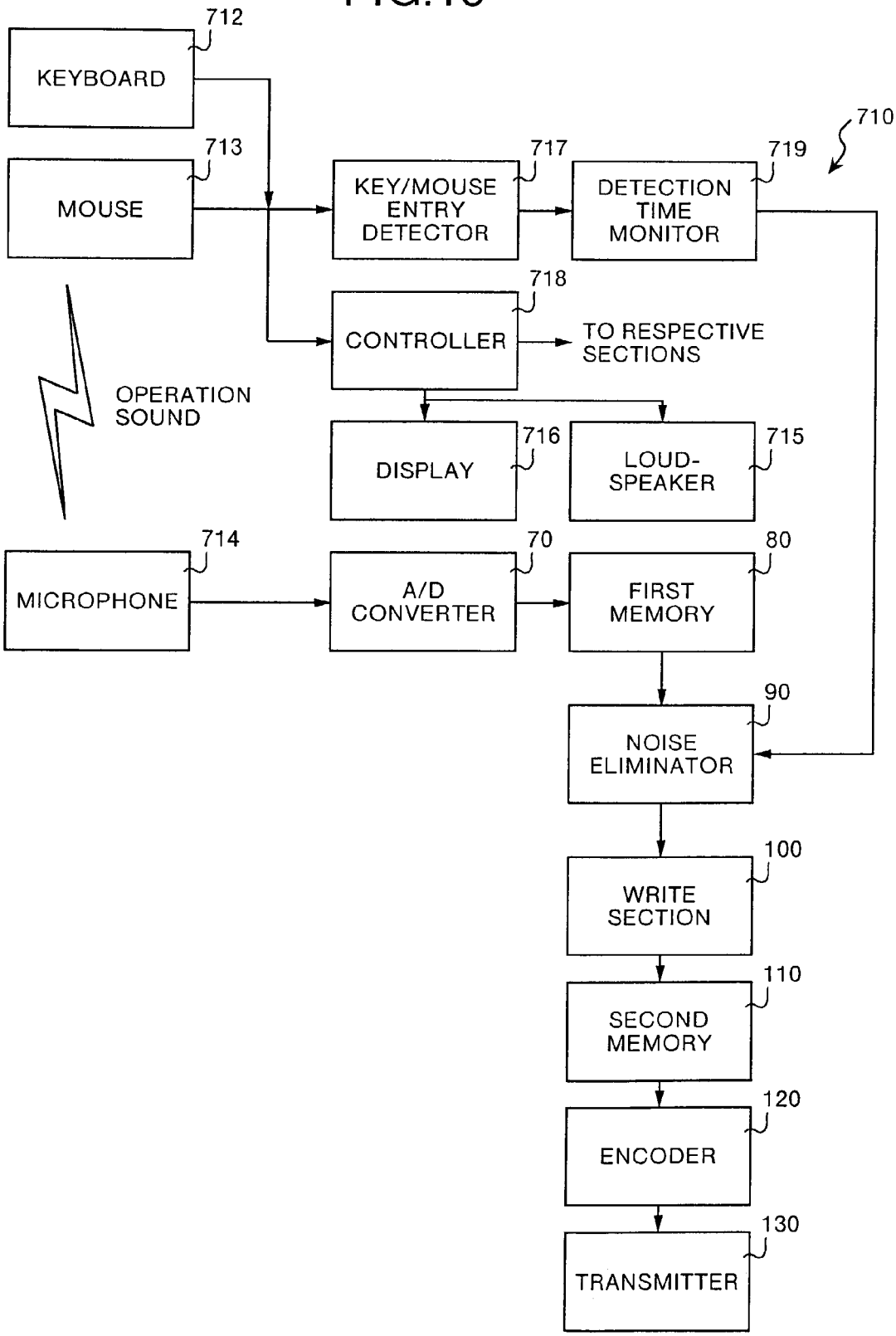
FIG. 15 is a block diagram showing the configuration of an IP telephone device 710 shown in FIG. 14.

FIG. 15 is a block diagram showing the configuration of the IP telephone device 710 shown in FIG. 14. In FIG. 15, portions corresponding to those in FIGS. 14 and 1 are denoted by the same reference symbols as those in FIGS. 14 and 1, respectively. FIG. 15 shows only a configuration for performing telephone conversations and various operations and eliminating the component of an operation sound.

A key/mouse entry detector 717 detects a key signal indicating that the keyboard 712 is operated and a mouse signal indicating that the mouse 713 is operated, and outputs the result of detection as a key/mouse detection signal.

In the seventh embodiment, when the keyboard 712 or the mouse 713 is operated during a telephone conversation, an operation sound is captured by the microphone 714 and superimposed on a speech signal. A controller 718 generates a control signal based on the key signal or the mouse signal. The controller 718 controls the respective sections based on the control signal.

A detection time monitor 719 monitors a key entry while using the rise and fall of the key/mouse detection signal from the key/mouse entry detector 717 as triggers. The detection time monitor 719 outputs the time of the rise (operation start time) and the time of the fall (operation end time) to the noise eliminator 90 as a detection time signal. The noise eliminator 90 executes the processing for waveform interpolation based on the operation start time and the operation end time which are obtained from the detection time signal.

The basic operations of the seventh embodiment are the same as those of the first embodiment except for the operations explained above. Namely, if the keyboard 712 or the mouse 713 is operated during a telephone conversation, an operation sound is captured by the microphone 714 and superimposed on a speech signal. Accordingly, the noise eliminator 90 executes the waveform interpolation processing in the same manner as that of the first embodiment to thereby eliminate the component of the operation sound from the speech signal and enhance tone quality.

As explained so far, the seventh embodiment can obtain the same advantages as those of the first embodiment.

The first to seventh embodiments of the present invention have been explained in detail so far with reference to the drawings. The concrete configuration examples of the invention are not limited to these first to seventh embodiments. Any changes and the like in design within the scope of the spirit of the present invention are included in the present invention.

Figure 16:
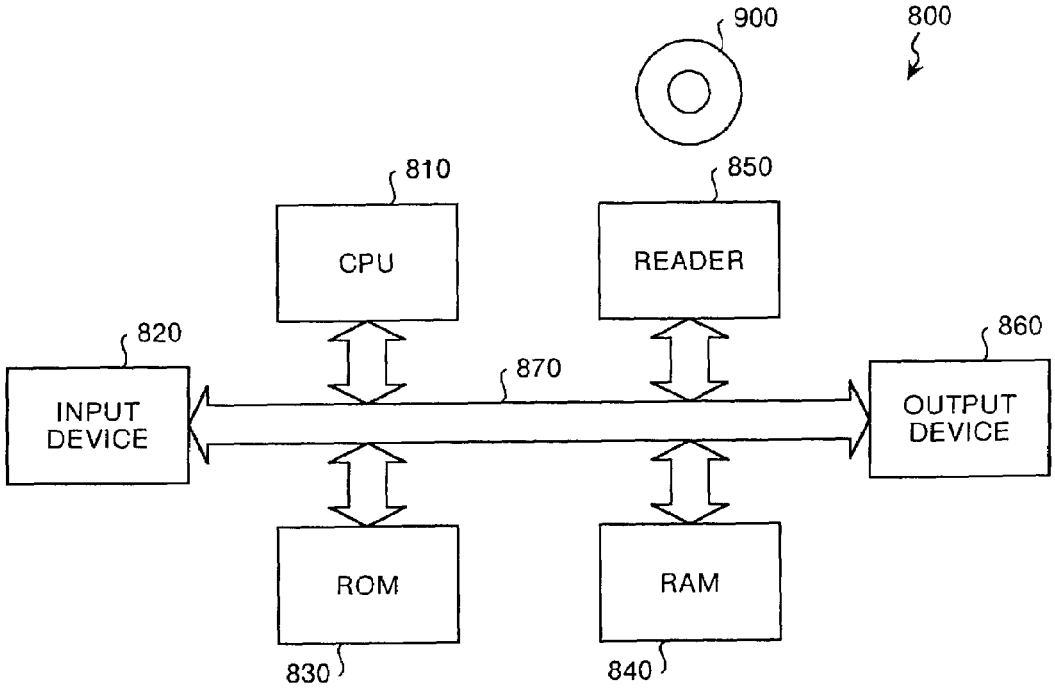
FIG. 16 is a block diagram showing the configuration of a modification of the first to seventh embodiments of the present invention.

For example, in the first to seventh embodiments, a program which realizes the functions (waveform interpolation, waveform suppression of the speech signal, and the like) of the portable terminal or the IP telephone device may be recorded on a computer readable recording medium 900 shown in FIG. 16 and the program recorded on this recording medium 900 may be loaded into and executed on a computer 800 shown in FIG. 16 so as to realize the respective functions.

The computer 800 shown in FIG. 16 comprises a CPU (Central Processing Unit) 810 that executes the program, an input device 820 such as a keyboard and a mouse, a ROM (Read Only Memory) 830 that stores various data, a RAM (Random Access Memory) 840 that stores arithmetic parameters and the like, a reader 850 that reads the program from the recording medium 900, an output device 860 such as a display and a printer, and a bus 870 that connects the respective sections of the computer 800 with one another.

The CPU 810 loads the program recorded on the recording medium 900 through the reader 850 and then executes the program, thereby realizing the functions. The recording medium 900 is exemplified by an optical disk, a flexible disk, a hard disk, and the like.

As explained so far, according to the present invention, when the operation of the man-machine interface is detected, the component of the operation sound of the man-machine interface is eliminated from the speech that is input within an operation-detected period. Therefore, it is advantageously possible to efficiently eliminate the operation sound as noise produced when the man-machine interface is operated, and to enhance tone quality.

According to the present invention, when the operation of the man-machine interface is detected, the component of the operation sound of the man-machine interface is eliminated from the speech that is input within an operation-detected period which is determined based on the information for the operation time. Therefore, it is advantageously possible to efficiently eliminate the operation sound as noise produced when the man-machine interface is operated, and to enhance tone quality.

According to the present invention, when the operation of the man-machine interface is detected, the information for an operation time is output based on a reference signal, and the component of the operation sound of the man-machine interface is eliminated from the speech that is input within an operation-detected period which is determined by this information for the operation time information. Therefore, it is advantageously possible to efficiently eliminate the operation sound as noise produced when the man-machine interface is operated, and to enhance tone quality.

According to the present invention, when the operation of the man-machine interface is detected, the component of the operation sound of the man-machine interface is eliminated from the speech that is input within the operation-detected period by performing waveform interpolation. Therefore, it is advantageously possible to efficiently eliminate the operation sound as noise produced when the man-machine interface is operated, and to enhance tone quality.

According to the present invention, when the operation of the man-machine interface is detected, a period in which the operation of the man-machine interface is detected, is suppressed in the speech that is input within the operation-detected period. Therefore, it is advantageously possible to efficiently eliminate the operation sound as noise produced when the man-machine interface is operated, and to enhance tone quality.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A speech input device comprising:

a speech input unit which inputs speech;

a first memory unit which accumulates and stores information on the speech that is input into the speech input unit;

a detection unit which detects an operation of a man-machine interface and outputs information for an operation time which corresponds to a start of the operation and an end of the operation;

a noise eliminator which reads the information stored in the first memory unit and the information output from the detection unit and eliminates a component of an operation sound of the man-machine interface from the speech that is input into the speech input unit within the operation time; and a second memory unit which accumulates and stores information on the speech that is output from the noise eliminator, wherein the noise eliminator eliminates the component of the operation sound of the man-machine interface from the speech that is input into the speech input unit by conducting waveform interpolation.

2. The speech input device according to claim 1, further comprising a conversion unit which converts analog information which is output when the man-machine interface is operated, into digital information, wherein the detection unit detects the operation based on the digital information.

3. The speech input device according to claim 1, wherein the man-machine interface is keys of a portable terminal which has a data communication function and a telephone conversation function.

4. The speech input device according to claim 1, wherein the man-machine interface is a keyboard of a computer which has a data communication function and a telephone conversation function.

5. The speech input device according to claim 1, wherein the man-machine interface is a mouse of the computer.

6. The speech input device according to claim 1, wherein the man-machine interface is an operation section of recording equipment which has a speech recording function.

7. A speech input device comprising:

a speech input unit which inputs speech;

a first memory unit which accumulates and stores information on the speech that is input into the speech input unit;

a control unit which outputs a control signal for controlling respective sections based on an operation signal indicating that a man-machine interface is operated;

a detection unit which detects an operation of the man-machine interface based on the control signal and outputs information for an operation time which corresponds to a start of the operation and an end of the operation;

a noise eliminator which reads the information stored in the first memory unit and the information output from the detection unit and eliminates a component of an operation sound of the man-machine interface from the speech that is input into the speech input unit within the operation time; and a second memory unit which accumulates and stores information on the speech that is output from the noise eliminator, wherein the noise eliminator eliminates the component of the operation sound of the man-machine interface from the speech that is input into the speech input unit by conducting waveform interpolation.

8. The speech input device according to claim 7, further comprising a conversion unit which converts analog information which is output when the man-machine interface is operated, into digital information, wherein the detection unit detects the operation based on the digital information.

9. The speech input device according to claim 7, wherein the man-machine interface is keys of a portable terminal which has a data communication function and a telephone conversation function.

10. The speech input device according to claim 7, wherein the man-machine interface is a keyboard of a computer which has a data communication function and a telephone conversation function.

11. The speech input device according to claim 7, wherein the man-machine interface is a mouse of the computer.

12. The speech input device according to claim 7, wherein the man-machine interface is an operation section of recording equipment which has a speech recording function.

13. A speech input method comprising steps of:

inputting speech by a speech input unit;

accumulating and storing information on the speech that is input by the speech input unit in a first memory unit;

detecting an operation of a man-machine interface and outputting information for an operation time which corresponds to a start of the operation and an end of the operation;

eliminating a component of an operation sound of the man-machine interface from the speech that is input in the speech inputting step within the operation time by reading the information stored in the first memory and the information output from the detecting; and accumulating and storing information on the speech that is output after the eliminating in a second memory unit, wherein said noise eliminating operation is performed by conducting waveform interpolation.

14. A computer-readable recording medium that stores a computer program that causes a computer to execute:

inputting speech by a speech input unit;

accumulating and storing information on the speech that is input by the speech input unit in a first memory unit;

detecting an operation of a man-machine interface and outputting information for an operation time which corresponds to a start of the operation and an end of the operation;

eliminating a component of an operation sound of the man-machine interface from the speech that is input into the speech input unit within the operation time; and accumulating and storing information on the speech that is output after the eliminating in a second memory unit, wherein said noise eliminating operation is performed by conducting waveform interpolation.

15. The computer-readable recording medium according to claim 14 causing the computer to further execute:

outputting a control signal for controlling respective sections based on an operation signal indicating that a man-machine interface is operated, wherein said detecting operation of the man-machine interface is based on the control signal.

16. A speech input device comprising:

a speech input unit which inputs a speech signal;

a first memory unit which accumulates and stores information on the speech signal that is input into the speech input unit;

a detection unit which detects an operation of a man-machine interface and outputs information for an operation time which corresponds to a start of the operation and an end of the operation;

a suppression processing unit which reads the information stored in the first memory unit and the information output from the detection unit and suppresses the amplitude of the waveform of the speech signal that is input into the speech input unit within the operation time; and a second memory unit which accumulates and stores information on the speech signal that is output from the suppression processing unit.

17. A speech input method comprising steps of:

inputting a speech signal by a speech input unit;

accumulating and storing information on the speech signal that is input by the speech input unit in a first memory unit;

detecting an operation of a man-machine interface and outputting information for an operation time which corresponds to a start of the operation and an end of the operation;

suppressing the amplitude of the waveform of the speech signal that is input in the speech inputting step within the operation time by reading the information stored in the first memory and the information output from the detecting; and accumulating and storing information on the speech signal that is output after the suppressing in a second memory unit.

18. A computer-readable recording medium that stores a computer program that causes a computer to execute:

inputting a speech signal by a speech input unit;

accumulating and storing information on the speech signal that is input by the speech input unit in a first memory unit;

detecting an operation of a man-machine interface and outputting information for an operation time which corresponds to a start of the operation and an end of the operation;

suppressing the amplitude of the waveform of the speech signal that is input into the speech input unit within the operation time by reading the information stored in the first memory and the information output from the detecting; and accumulating and storing information on the speech signal that is output after the suppressing in a second memory unit.

19. A speech input device comprising:

a first memory unit which accumulates and stores information on speech that is input into the speech input device;

a detection unit which detects an operation of a man-machine interface and outputs information for an operation time which corresponds to a start of the operation and an end of the operation;

a noise eliminator which reads the information stored in the first memory unit and the information output from the detection unit and eliminates a component of an operation sound of the man-machine interface from the speech that is input into the speech input device within the operation time; and a second memory unit which accumulates and stores information on the speech that is output from the noise eliminator.

* * * * *